US006049263A

United States Patent [19]

Vilou

[11] Patent Number: 6,049,263

[45] Date of Patent: Apr. 11, 2000

[54] STARTER CONTACTOR INCORPORATING AN ELECTRONIC CONTROL CIRCUIT, AND A VEHICLE STARTER HAVING SUCH A CONTACTOR

[75] Inventor: Gérard Vilou, Tassin, France

[73] Assignee: Valeo Equipements Electronics Moteur, Creteil, France

[21] Appl. No.: 08/924,112

[22] Filed: Sep. 5, 1997

[30] Foreign Application Priority Data

Sep. 6, 1996 [FR] France ..... 96 11007

[51] Int. Cl.[7] ..... H01H 67/02

[52] U.S. Cl. ..... 335/126; 335/131; 290/38 R

[58] Field of Search ..... 335/126, 128, 335/131; 290/38 R, 48

[56] References Cited

U.S. PATENT DOCUMENTS 4,227,231 10/1980 Hansen et al. .

4,644,179 2/1987 Pointout et al. .

5,703,551 12/1997 Lefbvre et al. ..... 335/126

FOREIGN PATENT DOCUMENTS 155 983 10/1985 European Pat. Off. .

*Primary Examiner*—Michael L. Gellner
*Assistant Examiner*—Tuyen T. Nguyen
*Attorney, Agent, or Firm*—Morgan & Finnegan, L.L.P.

[57] ABSTRACT

A motor vehicle starter has a contactor of the type that includes an electronic control circuit, which includes a printed circuit board in the form of a disc with a central hole through which the body of the control rod of the contactor passes. The electronic components of the control circuit are carried by the circuit board, which is located in an axial position within the interior of the pot-shaped end cap of the contactor, between the fixed core and the movable contact of the contactor. The electronic control circuit is mounted within a protective housing which is arranged inside the end cap, between the fixed core and the movable contact, and this housing also has electrical connection facilities.

14 Claims, 3 Drawing Sheets

STARTER CONTACTOR INCORPORATING AN ELECTRONIC CONTROL CIRCUIT, AND A VEHICLE STARTER HAVING SUCH A CONTACTOR

FIELD OF THE INVENTION

The present invention relates to contactors for the starters of internal combustion engines for motor vehicles.

BACKGROUND OF THE INVENTION

In a known design, such a starter contactor comprises a cylindrical annular armature, in which a solenoid coil or winding is arranged, the winding actuating a core which is movable axially within the armature so as to act on a control rod which extends axially through the centre of a fixed core. The fixed core is in the form of a disc and is arranged at a front axial end of the armature. The control rod effects axial displacements of a movable contact in and out of cooperating contact with two fixed power contact terminals that are connected, on the outside of the contactor, with the power supply circuit for the starter motor. These fixed contacts are mounted in the base of an end cap or cover which has the general form of a cylindrical pot, with a lateral skirt or side wall. The armature and the end cover thus together constitute a hollow casing of the contactor, the interior of which is an internal contactor chamber, and the movable contact is inside this chamber.

It is also known to control the contactor by means of an electronic control circuit which includes a support, typically consisting of a printed circuit board with electronic components carried by this support. In some known designs, the electronic control circuit is mounted inside a fully sealed housing which is then fixed on the outside of the starter, either on the support pedestal (or equivalent) of the starter, or on the contactor itself, or on the yoke of the electric starter motor. The housing for the electronic control circuit may also be fixed on the bodywork of the vehicle within the engine compartment.

It is then necessary in all cases to provide wires or cables which connect this housing, firstly with the starter contactor, and secondly with the other parts of the vehicle which are necessary for the control of starting of the engine, such as the ignition switch, the steering lock, an electronic computer unit for controlling fuel injection and ignition, and so on.

Thus the arrangement of the electronic control circuit within an independent housing makes it necessary to provide an additional component, which occupies space, which requires additional electrical connections, and which makes it necessary to carry out additional assembly operations on the vehicle.

DISCUSSION OF THE INVENTION

According to the invention in a first aspect, a contactor for a motor vehicle starter, of the type comprising an annular cylindrical armature, in which is arranged a solenoid coil that actuates an axially movable core which acts on a control rod which extends through the centre of a fixed core in the form of a disc disposed at a front axial end of the armature, being also of the type in which the control rod governs displacements of a movable contact which is adapted to cooperate with two fixed contact terminals of the power supply circuit for the motor of the starter, the said fixed contact terminals being arranged in the base portion of an end cover, a lateral skirt portion of which defines an end cap chamber in which the movable contact is mounted, and being further of the type including an electronic circuit for controlling the contactor, the control circuit including a disc-shaped support, in particular a printed circuit board, which has a central through hole for passage of the body of the control rod through it, the said support being disposed axially within the end cover between the fixed core and the movable contact, the support carrying electrical components, is characterised in that the electronic control circuit is disposed within a protective and connecting housing disposed axially within the end cover, between the fixed core and the movable contact.

According to a preferred feature of the invention, the housing has a cylindrical side wall and a transverse front wall, which together define a generally cylindrical chamber within which the electronic control circuit is disposed, the open transverse rear face of the housing being adjacent to the transverse front face of the fixed core.

Preferably in that case, the rear axial end of the side wall of the housing is extended by a radial flange which bears axially against the transverse front face of the fixed core. Preferably, the radial flange of the housing is interposed axially between mutually facing annular surfaces of the transverse front face of the fixed core and of the end cap.

According to another preferred feature of the invention, the side wall of the housing includes means for axial and/or angular positioning of the support of the electronic control circuit within the housing.

According to a further preferred feature of the invention, the transverse front wall of the housing includes at least one aperture for the passage of an electrical connecting element. In some embodiments with this arrangement, the electrical connecting element is a connecting tag which extends axially from the front face of the support of the electronic control circuit. Alternatively or in addition, the electrical connecting element is a wire which extends axially from the windings of the solenoid coil, through a hole in the support of the electronic control circuit.

Preferably, each aperture in the transverse front wall of the housing is formed in a component of electrically insulating material. In some embodiments with this arrangement, each aperture is formed in a component of insulating material fitted within a hole in the transverse front wall of the housing. In other embodiments, the transverse front wall of the housing is made in an insulating material and has at least one through hole for the passage of an electrical connecting element.

According to yet another preferred feature of the invention, at least one of the electrical connecting elements that pass through the transverse front wall of the housing extends axially through the base portion of the end cap. In preferred embodiments of this arrangement, in which, also, each aperture in the transverse front wall of the housing is formed in an electrically insulating element, the said component of insulating material includes an extension which projects axially towards the end cap and which is received in a complementary seating in the base portion of the end cap, and in that the said electrical connecting element extends axially through the said extension and the said seating.

The housing preferably includes a central sleeve for guiding the control rod in sliding movement.

In preferred embodiments of the invention, in a rest position, the movable contact bears axially against the outer face of the transverse front wall of the housing.

According to the invention in a second aspect, a motor vehicle starter has a contactor according to the said first aspect of the invention.

Further features and advantages of the invention will appear more clearly on a reading of the following detailed description of a preferred embodiment of the invention, which is given by way of non-limiting example only and with reference to the accompanying drawings.

BRIEF DESCRIPTION OF THE DRAWINGS

FIG. 2 is a view in axial cross section of the same contactor as in FIG. 1, but in this case the plane of the cross section is offset by 90 degrees with respect to the cross section plane in which FIG. 1 is drawn.

DESCRIPTION OF A PREFERRED EMBODIMENT OF THE INVENTION

Figure 1:
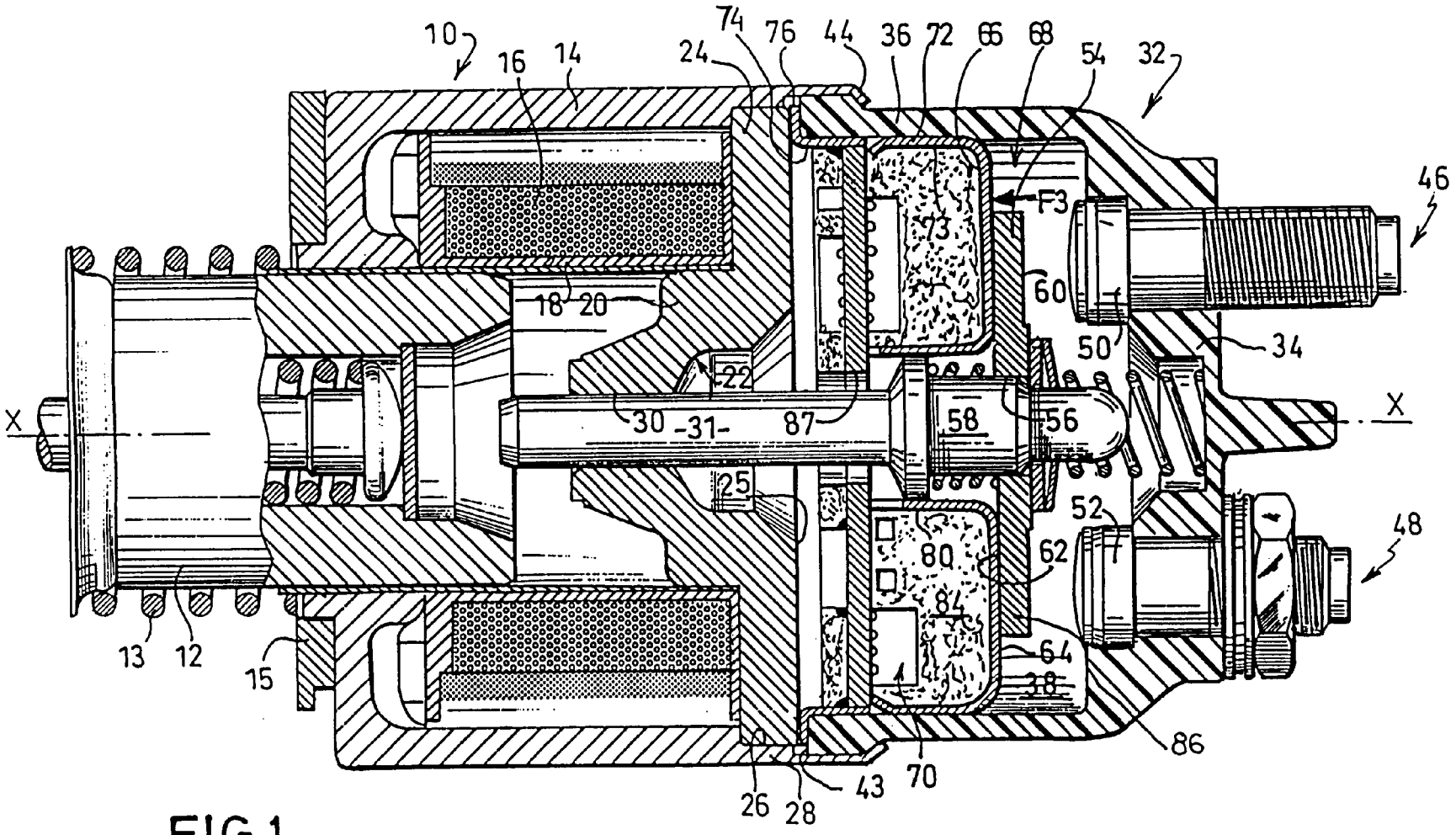
FIG. 1 is a view in axial cross section taken on the line 1—1 in FIG. 2, of a starter contactor in accordance with the invention.
Figure 2:
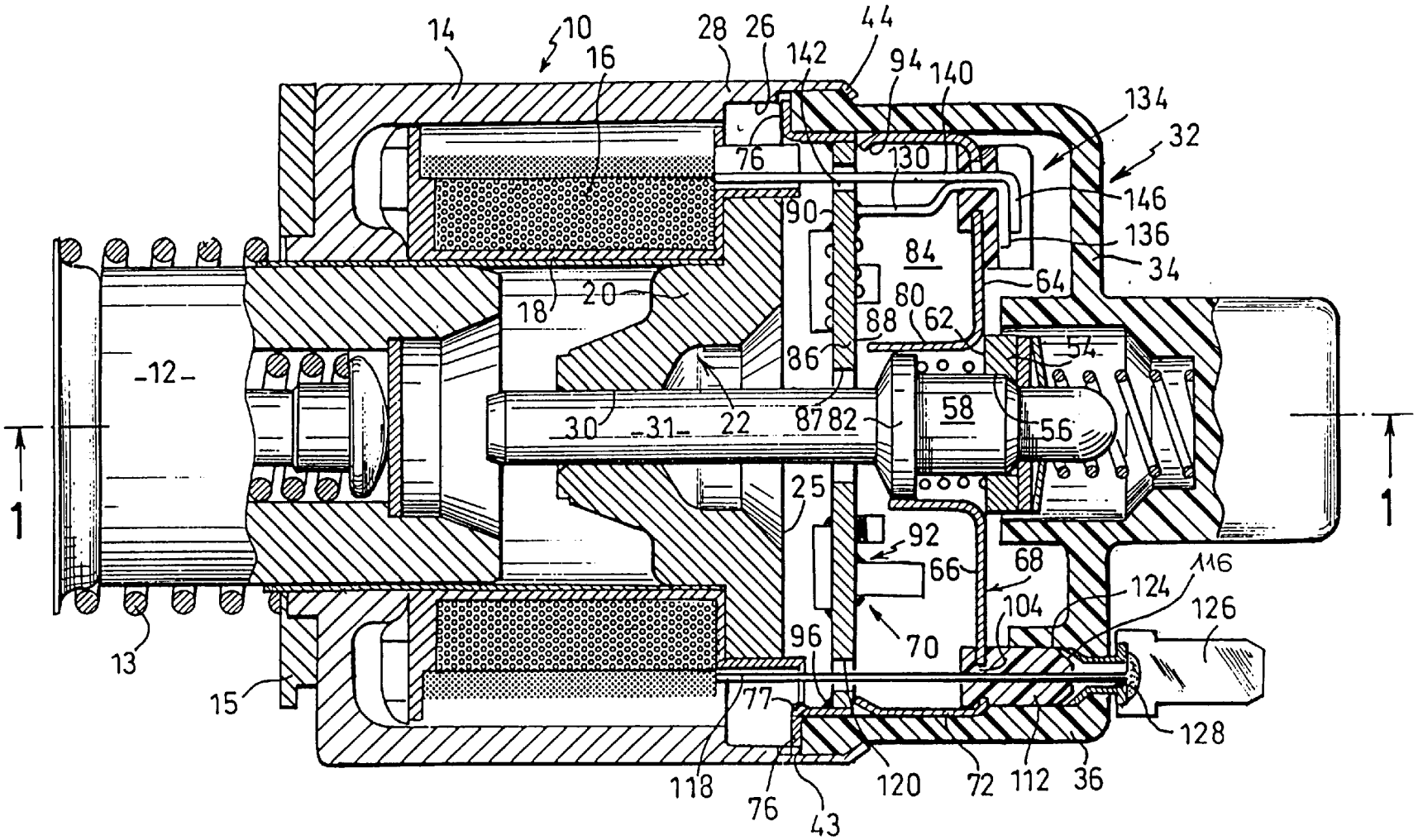

FIGS. 1 and 2 show an electromagnetic contactor 10 which is designed to form part of a starter (not shown) for an internal combustion engine of a motor vehicle. The contactor 10 includes a movable core 12 which is coupled to one end of a pivoting lever (not shown), the other end of which is coupled to the driving element of the starter head of the starter.

The electromagnetic contactor 10 also has an external armature 14, which may also be referred to as the barrel or the casing body, and which is of annular generally cylindrical form with an axis X—X. Disposed inside the barrel 14 is, in particular, an annular solenoid coil 16.

The movable core 12 is mounted for sliding movement within a tubular skirt 18 which is fixed on the central portion 20 of a fixed core 22. The fixed core 22 is generally in the form of a disc having a flat annular main portion 24 which lies in a transverse plane at right angles to the axis X—X. This main portion 24 of the fixed core is secured in a rebate 26 formed in the front axial end 28 of the armature 14. The central portion 20 of the fixed core 22 has a central through hole 30, and the movable core 12 acts on a control rod 31, which is mounted in the hole 30 and guided by the latter in axial sliding movement in the fixed core 22.

The contactor has a casing which consists generally of the armature or casing body 14 and an end cap 32 which is fixed to the open front end of the casing body 14. The end cap 32 is a moulded component made from a suitable insulating material, for example a thermoplastics material. The end cap 32 is in the general form of a cylindrical pot centred on the axis X—X, and comprises a radially extending terminal base portion 34 lying at right angles to the axis X—X, with a cylindrical side wall or skirt portion 36 projecting from the base portion 34.

The main part of the skirt portion 36 defines a cylindrical internal chamber 38 of the contactor, and in particular an end cap chamber. The annular terminal edge 43 of the skirt portion 36 is in indirect axial abutment, as will be explained later in this description, against the front transverse face 25 of the disc-shaped main portion 24 of the fixed core 22. The front end 28 of the armature 14 is extended by a thin axial end portion 44, which is upset radially inwards over an external terminal bead of the end cap skirt portion 36, thereby sealingly securing the end cap 32 and armature 14 together.

In a manner known per se, the contactor 10 has two fixed terminals of electrically conductive material, 46 and 48, which are encapsulated in the moulding of the base portion 34 of the end cap 32. Each fixed terminal 46, 48 has an exposed contact head 50, 52 respectively, within the chamber 38 and orientated generally in a plane at right angles to the axis X—X.

Again in a manner known per se, the control rod 31 carries at its front end a movable contact 54 in the form of a rectangular plate which has a central through hole 56. The control rod 31 has a portion 58 of enlarged diameter which is engaged in this hole 56.

In the rest position shown in FIG. 1, the movable core 12, the control rod 31 and the movable contact 54 are biassed resiliently, towards the left in FIG. 1, by a return spring 13 which is interposed between the movable core 12 and the radial rear end face 15 of the armature 14.

In the working position, that is to say when the solenoid coil or winding 16 is energised, the movable core 12 and the control rod 31 drive the moving contact 54 in the forward axial direction, i.e. from left to right with reference to FIG. 1, until the front face 60 of the moving contact 54 meets the heads 50 and 52 of the fixed terminals 46 and 48, to make electrical contact with them.

In the embodiment shown in the drawings, the moving contact 54 bears in the rest position, through its rear face 62, against the front face 64 of a radially orientated front transverse wall 66 which is part of a housing 68 for the protection and connection of an electronic control circuit 70.

Again in the embodiment shown in the drawings, the housing 68 is a fabricated metal component formed in sheet metal, in particular by stamping and press forming. The housing 68 has the general form of a cylindrical pot, the transverse base portion, or front wall, 66 of which is extended axially towards the rear by a cylindrical side wall 72 having a free edge 74 at its axial rear end, this terminal rear edge 74 being extended radially outwardly by a radial end flange 76.

The inner radial edge of the front transverse base portion 66 of the housing 68 is extended axially inwards, that is to say towards the rear of the contactor, by a sleeve portion 80. The control rod 31 has an external radial shoulder portion 82 which joins the cylindrical main shank, or rear portion, of the control rod 31 to its front portion 58 of enlarged diameter, already mentioned above. The shoulder portion 82 is received and guided, in sliding movement, in the sleeve portion 80 of the housing 68.

The front transverse walls 64 and the cylindrical side wall 72 of the housing 68 define an internal chamber 84 of the latter, the chamber 84 being of generally annular form with the electronic control circuit 70 mounted within it. The housing 68 is fixed on the disc-shaped main portion 24 of the fixed core 22 by means of its end flange 76, which is for example welded on the front transverse face 25 of the fixed core 22.

This welded joint may be completed, or replaced, by a suitable form of mechanical fastening, in particular seaming or resilient mating cooperation. In the case of a housing 68 which is made entirely of conductive metal plate, the fastening of the housing 68 on the metallic fixed core 22 enables the housing to be connected electrically to ground (earth) through the fixed core, so that no particular electrical connection is necessary for the housing 68.

During assembly of the end cap 32 on the armature 14, by the seaming operation in which the thin end portion 44 of the armature 14 is upset, the flange 76 is in addition gripped between an annular surface portion, in facing relationship with it, of the transverse front end face 25 of the fixed core 22 and the annular rear end, or terminal edge, 43 of the skirt portion 36 of the end cap 32.

In a manner known per se, and as seen in FIG. 2, the electronic control circuit 70 consists essentially of a support, which is here in the form of a printed circuit board 86, and which is in the general form of a disc having a central hole 87, through which the control rod 31 passes. The various electronic components, indicated at 92, of the control circuit are carried on its two transverse faces, namely its front face 88 and its rear face 90.

Figure 6:
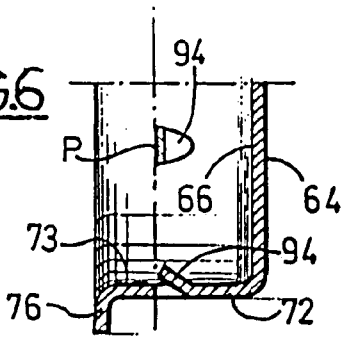
FIG. 6 is a view in cross section taken on the line 6—6 in FIG. 4.

In accordance with the present invention, the electronic control circuit 70 is disposed, and fixed, within the protective and connecting housing 68, within the chamber 84 defined in the latter. For locating the circuit 70 axially, and as can be seen in greater detail in FIGS. 4 to 6, to which reference is now made, the cylindrical side wall 72 of the housing 68 has a set of nibs 94 formed on its concave inner face 73. In this example the nibs 94 are in the form of pressed-out tabs in the side wall 72, and all of the nibs 94 lie in a common radial plane P of orientation, so as to define a plane in which the printed circuit board 86 is in axial abutment with the front of the nibs 94, thereby determining a precise axial positioning for the electronic control circuit 70 in its housing 68.

The side wall 72 may also include suitable means, not shown in the drawings, for positioning the disc-shaped printed circuit board 86 against rotation within the housing 68.

The circuit board 86, and therefore the electronic control circuit 70, is fastened axially within the housing 68 by a soldering operation during which an annular ring 96 of solder, or weld metal, is created, see FIG. 2. This ring 96 may be continuous or discontinuous, but in either case it gives the assembly excellent resistance to vibrations, and a high natural frequency of vibration.

Conductive tracks are provided on the two opposed faces 88 and 90 of the printed circuit board 86, in particular in the vicinity of the periphery of the latter, and are such that the housing 68 is connected electrically to these conductive tracks through the nibs or tabs 94 and the ring of solder 96.

In order to improve the weldability, or ability to be soldered, of the housing 68, and also to improve its corrosion resistance, the metal blank from which the housing 68 is press-formed may be coated with a suitable coating, especially on the internal face of the component and therefore also on the transverse rear end face 77 (FIG. 2) of the end flange 76.

There will now be described the various means for mechanically and electrically connecting the electronic control circuit 70 with the solenoid coil or winding 16 or the end cap 32, and for making the connections between the winding 1 6 and the end cap 32, passing through the printed circuit board 86.

Figure 7:
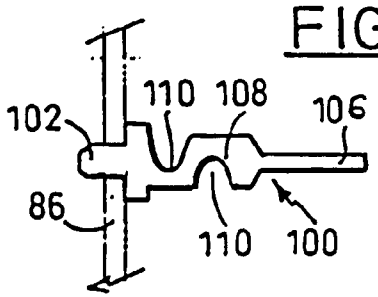
FIG. 7 is another scrap view, showing an electrical connecting tag for connecting the electronic control circuit to the end cap of the contactor.

The electrical connection of the electronic control circuit 70 to the end cap 32, in particular with a view to connecting this circuit to the general supply circuit by which the contactor is supplied with a voltage using the ignition key of the vehicle, is provided through a connecting terminal or tag 100, one possible embodiment of which is shown in FIG. 7. The tag 100 consists of a flat tongue in the form of a stamping, which is soldered to the printed circuit board 86 at the same time as the electronic components 92, through its end portion 102 which is adapted to be fitted in a hole of complementary form in the printed circuit board 86, so as to enable the tag 100 to be secured to the latter by soldering.

The opposite end portion 106 of the tag 100 is tapered and is of reduced dimensions, so that it can extend through a hole 104 (see FIG. 4) which is formed in the transverse front wall 66 of the housing 68, and so that its terminal portion that extends axially towards the front of the contactor, outside the housing 68, can be soldered to the outside of the contactor.

The body 108 of the tag 100 is formed with lateral cutouts 110, which give it longitudinal elasticity so that the tongue 100 is able to adapt to dilations and relative movements between the end cap 32 and the printed circuit board 86, without any detrimental mechanical stresses being applied to the latter during operation, and without any detriment to the integrity of the electronic control circuit 70.

Figure 4:
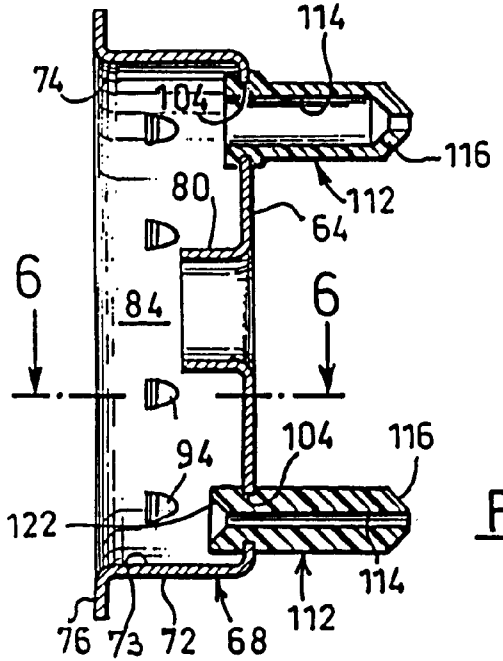
FIG. 4 is a view in cross section taken on the line 4—4 in FIG. 3.
Figure 3:
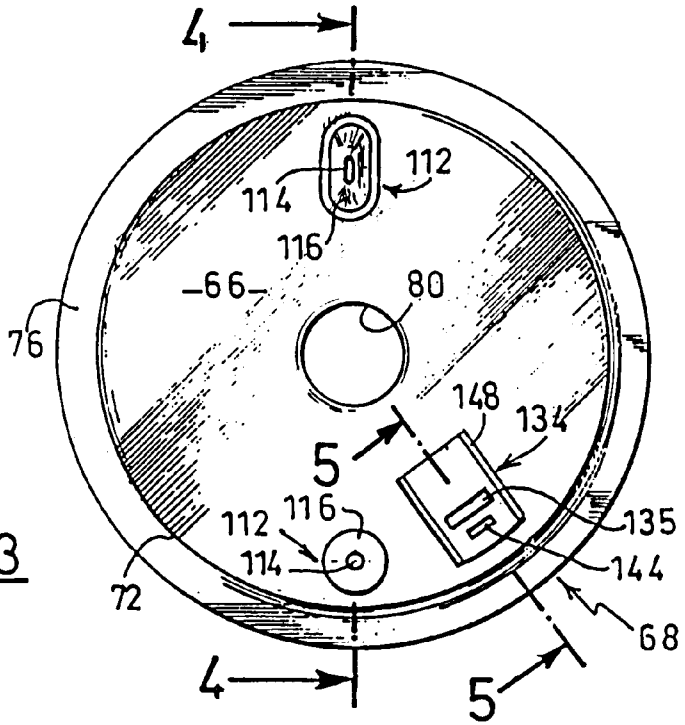
FIG. 3 is a view in the direction of the arrow F3 in FIG. 1, showing the housing of the electronic control circuit of the contactor shown in FIGS. 1 and 2.

In order to take the electrical connections through the holes 104 in the housing 68 without any short circuit, the housing carries a bush or sleeve 112, shown in the upper part of FIGS. 3 and 4. The sleeve 112 is made of an electrically insulating material, which is attached in a manner known per se, and which is secured for example by being moulded in place or by being a separate component fitted in the hole 104, so that it extends beyond the front face 64 of the front wall 66 of the housing 68. The bush or sleeve 112 has a central bore 114 which receives and guides the connecting terminal 100, and in this way it contributes to the angular indexing of the printed circuit board 86 with respect to the housing 68. The bush 112 also has a chamfered free end 116 at its axial front end, in order to facilitate its introduction into a complementary seating formed in the base portion 34 of the end cap 32. One embodiment of this arrangement will be described later in this description.

As shown in FIG. 2, the electrical connection of the windings of the solenoid coil 16 to the end cap 32 is obtained by means of at least one conductive wire 118 which extends axially from the coil 16 through the main portion 24 of the fixed core 22, from which it passes through a hole 120 formed in facing relationship in the printed circuit board 86. The wire 118 then passes through the transverse front wall 66 of the housing 68 via one of the holes 104 in the latter, which, as in the case of the other hole 104 which contains the connecting terminal or tag 100, is equipped with an insulating bush or sleeve 112 (see the lower part of FIGS. 3 and 4). This bush 112 is of generally similar design to the bush 112 described above, except that its internal bore 114 is of smaller dimensions to accommodate the wire 118, and is countersunk at 122, at its rear end, to permit easy introduction of the wire I 1 8.

As can be seen in the lower part of FIG. 2, the chamfered front axial end 116 of the insulating bush 112 is received axially in a complementary seating 124 formed in the base portion 34 of the end cap 32. The seating 124 is open axially on the outside, so as to enable the wire 118 to pass through it. The wire can then be connected by soldering on a terminal tag 126 of the end cap 32. The arrangement comprising the seatings 124 receiving the bushes 112 enables the end cap 32 to be guided and indexed while the end cap is being fitted around the housing 68.

The protruding ends of the connector 100 and/or of the wire 118 are protected and retained by the insulating bushes or sleeves 112, which prevents them from becoming damaged while the end cap is being fitted. To this end, the axial length of the sleeves 112 is such that they begin to centre themselves in the complementary seatings 124 in the end cap 32 before the projecting ends of the electrical connecting elements 100 and 118 have reached the external passage holes 128 formed in the base portion 34 of the end cap 32.

There will now be described one way of connecting the solenoid coil 16 electrically to the electronic control circuit 70, this electrical connection being provided indirectly through soldering to the outside of the protective and connecting housing 68.

Figure 5:
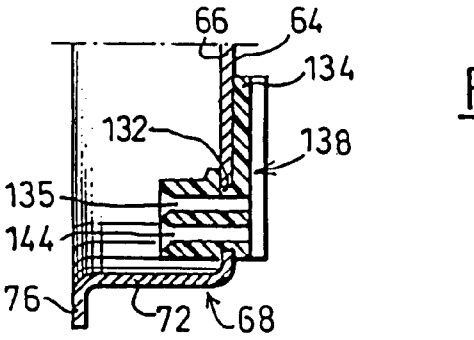
FIG. 5 is a scrap view, in cross section taken on the line 5—5 in FIG. 3.

To this end, a connector in the form of a flat tongue 130, FIG. 2, is fitted and soldered beforehand on the printed circuit board 86, as is the connector 100. The tongue 100 extends axially towards the front so as to pass through a hole 132 (see FIG. 5) formed in the front transverse wall 66 of the housing 68. A wire guide insert 134 of suitable insulating material, seen in FIGS. 1, 3 and 5, is fitted in the hole 132. The insert 134 is formed with a first open passage 135 for accommodating the tongue 130. As shown in FIG. 2, the terminal end portion 136 of the tongue 130, which projects axially through the passage 135 and out of the housing 68, is bent back radially at 90 degrees so as to bear against the front face 138 of the body of the wire guide insert 134 that lies outside the housing 68, along the front face 64 of the transverse front wall 66 of the latter.

An electric wire 140, FIG. 2, extends axially through a hole 142 in the printed circuit board 86, and thence through a second passage 144 formed through the wire guide insert 134, the rear end of the wire (to the left as seen in FIG. 2) being connected to the solenoid winding 16. The free end portion 146 of the wire 140, which lies outside the housing 68, is bent back at 90 degrees radially inwardly so as to be engaged against the bent-back portion 136 of the tongue 130, on which it can be soldered outside the housing 68.

The passages 134 and 144 are made as small as possible, to avoid any flow of solder into the interior of the housing 68.

The fact that elements of this assembly are bent through 90 degrees before the soldering operation, without any direct mechanical connection with the housing 68, gives the assembly a sufficient degree of elasticity to avoid the transmission of any mechanical stresses that could be detrimental to the electronic control circuit 70, in spite of the movements of low amplitude that can occur between the printed circuit board 86 and the solenoid winding 16 of the contactor 10 due to thermal dilation or vibrations.

In another version, the various components of insulating material, such as those denoted 112, 134 etc. can be made in the form of a single element having arms joining them together, this single component then being carried on the transverse front wall 66 of the housing 68. It is fixed to the latter in any suitable way, for example by snap-fitting, seaming, hot riveting, or ultrasonic welding. The metallic base portion 66 of the housing 68 may itself be made in the form of a plate moulded in a suitable plastics material and including the bushes or sleeves and the wire guide, these elements being moulded integrally with the plastics plate, instead of being separate pieces applied to the latter as inserts.

In a further version, the housing 68 may itself be made entirely in moulded plastics material. It is then necessary, however, to give it a coating of a metallic layer that extends from the end flange 76 up to the plane P, so as to enable the printed circuit board 86 to be soldered on the housing, and also so as to enable the circuit board 70 to be connected electrically to ground (earth) with respect to the fixed core 22.

Electrical contact between the housing 68 and the fixed core 22 is obtained by virtue of the pressure resulting from the seaming of the thin end portion 44 of the barrel 14 about the rear axial end of the skirt portion 36 of the end cap 32. This contact pressure may be increased by interposing, for example, a resilient ring between the rear axial end 43 of the end cap and the end flange 76 of the housing 68, or between the fixed core 22 and the housing 68.

In a contactor according to the invention, for example in the embodiment described in detail above, fitting and assembly of the electronic control circuit 70 in the contactor is particularly easy. The circuit 70 is protected against shock, and against the stresses involved in handling, as well as thermal stresses, prior to being assembled into the contactor, by the protective and connecting housing 68. It is also protected against parasitic effects from electric arcs occurring in the region of the power contacts during operation of the starter.

What is claimed is:

1. A motor vehicle starter contactor, comprising: a casing comprising a hollow annular cylindrical armature having an open front end and a hollow end cap secured on the front end of the armature, the end cap having a base portion and a lateral skirt portion extending from the base portion and defining within the end cap an internal chamber open towards the interior of the armature, the casing defining a contactor axis; a pair of fixed power contact terminals carried by the base portion of the end cap; an axially movable contact within the internal chamber, a control rod extending axially in the internal chamber and carrying the movable contact; a fixed core in the form of a disc mounted radially in the front end of the armature, the fixed core having a central hole mounting the control rod for axial displacement of the control rod therein, wherein the control rod can displace the movable contact into and out of cooperation with the fixed power contact terminals; a movable core, with the armature mounting the movable core within the armature for axial displacement of the movable core wherein the movable core acts on the control rod to effect said axial displacement of the control rod; a solenoid winding mounted in the armature for actuating the movable core in said axial displacement thereof; and an electronic control circuit for the contactor, the circuit comprising a disc-shaped support having a central through hole, the support being located within the end cap in an axial position between the fixed core and the movable contact, the control circuit further including electronic components carried by the support, wherein the contactor further includes a housing disposed within the end cap in a location in said internal chamber between the fixed core and the movable contact, the electronic control circuit being disposed within the housing wherein to be protected by the housing; and the contactor further including electrical connection means carried by the housing, wherein the housing has a transverse front wall and a cylindrical side wall extending from the front wall to define a generally cylindrical housing chamber within the housing, the electronic control circuit being mounted within the housing chamber, and the housing chamber having an open rear end adjacent to the front face of the fixed core.

2. A contactor according to claim 1, wherein the side wall of the housing has an axial rear end and a radial flange at said rear end, the flange bearing against the transverse front face of the fixed core.

3. A contactor according to claim 2, wherein the transverse front face of the fixed core defines a first annular surface, the end cap defines a second annular surface in facing relationship with the first annular surface, and the end flange of the housing is interposed axially between the first and second annular surfaces.

4. A contactor according to claim 1, wherein the side wall of the housing includes locating means for locating the support of the electronic control circuit within the housing.

5. A contactor according to claim 1, wherein the transverse front wall of the housing defines at least one aperture, the electrical connection means comprising electrical connecting elements extending through the at least one aperture.

6. A contactor according to claim 5, having an electrical connecting element in the form of a connecting tag, the support of the electronic control circuit having a front face and the tag extending axially forward from the front face of the support.

7. A contactor according to claim 5, having an electrical connecting element in the form of a wire, the support of the electronic control circuit having at least one through hole, the wire extending axially from the solenoid winding and through said hole in the support.

8. A contactor according to claim 5, wherein the housing includes at least one electrically insulating element in the transverse front wall of the housing, the at least one aperture being formed in the at least one insulating element.

9. A contactor according to claim 8, wherein the transverse front wall of the housing has at least one through hole, the at least one insulating element comprising a component fitted in the at least one through hole.

10. A contactor according to claim 8, wherein the transverse front wall of the housing is made of an electrically insulating material and defines at least one through hole therein constituting said at least one aperture for the passage of an electrical connecting element therethrough.

11. A contactor according to claim 5, wherein at least one electrical connecting element that extends through the transverse front wall of the housing also extends axially through the base portion of the end cap.

12. A contactor according to claim 8, wherein at least one electrical connecting element that extends through the transverse front wall of the housing also extends axially through the base portion of the end cap, the electrically insulating element including an extension extending axially towards the end cap, the base portion of the end cap defining a seating complementary to and receiving the extension, the corresponding electrical connecting element extending axially through the extension and seating.

13. A contactor according to claim 1, wherein the housing further includes a central guide sleeve portion, with the control rod extending through the sleeve portion to be guided by the sleeve portion in axial sliding movement.

14. A contactor according to claim 1, wherein the transverse front wall of the housing has an outer face, the movable contact being so disposed as to bear axially against the outer face of the transverse front wall of the housing in a rest position of the contactor.

* * * * *